US005402700A

United States Patent [19]

Cohen

[11] Patent Number: 5,402,700

[45] Date of Patent: Apr. 4, 1995

[54] MULTI-RING WIND CHIME

[76] Inventor: Paul I. Cohen, Box 92, Bearsville, N.Y. 12409

[21] Appl. No.: 67,112

[22] Filed: May 26, 1993

[51] Int. Cl.[6] ..... G10D 13/08

[52] U.S. Cl. ..... 84/404; D10/116

[58] Field of Search ..... 84/402, 403, 404, 406; 116/141, 169; 446/418; D17/22, 99; D10/116

[56] References Cited

U.S. PATENT DOCUMENTS

| | | | |
|---|---|---|---|
| D. 297,129 | 8/1988 | Andersen | D10/116 |
| D. 317,419 | 6/1991 | Ronzheimer | D10/116 |
| 4,686,878 | 8/1987 | Hebert | 84/404 |
| 4,693,162 | 9/1987 | Lee | 84/404 |
| 4,967,633 | 11/1990 | Jewell, Jr. | 84/404 |

OTHER PUBLICATIONS

Armchair Shopper, Grandview Mo., p. 36 Spring Catalog.

Harriet Carter, North Wales Pa. p. 82 Spring Catalog.

*Primary Examiner*—M. L. Gellner

*Assistant Examiner*—Cassandra C. Spyrou

[57] ABSTRACT

The present invention consists of an upper support structure including a wind vane which moves the wind chime according to the direction of the wind and a multiplicity of metallic rings mounted by string-like members to the upper holding support structure, which rings are driven by the force of the wind. The combination of either changing wind direction or velocity causes the rings to hit each other which produces an unexpectedly loud and melodic sound.

6 Claims, 1 Drawing Sheet

MULTI-RING WIND CHIME

FIELD OF USE

This invention is in the field of wind chimes that are both visually attractive and produce a bell-like sound when blown by an air current such as wind.

BACKGROUND OF THE INVENTION

Most wind chimes operate by having the wind move a striker that strikes the hollow tubes or rods of different lengths that vibrate at a different fundamental frequencies. Some wind chimes operate by having parts move and strike each other when blown by the wind to produce a sound. However, the sound produced by most wind chimes is not particularly loud, so that if hung outside of a house the sound inside the house is quite muted.

SUMMARY OF THE PRESENT INVENTION

The present invention consists of an upper support structure including a wind vane which moves the wind chime according to the direction of the wind and a multiplicity of metallic rings mounted by string-like members to the upper holding support structure, which rings are driven by the force of the wind. The combination of either changing wind direction or velocity causes the rings to hit each other which produces an unexpectedly loud and melodic sound.

Thus it is an object of this invention to have a wind chime which is driven by the change in either or both wind direction and/or wind velocity.

Another object of this invention is that the appearance and movement of the mounting vane and rings be aesthetically pleasant in a manner analogous to a mobile.

Still another object of this invention is that a comparatively loud and melodious sound be produced when the rings strike each other.

These and other objects and advantages of this invention will become apparent upon careful reading of the detailed description of this invention as presented herein.

DETAILED DESCRIPTION OF THE DRAWINGS

Figure 1:
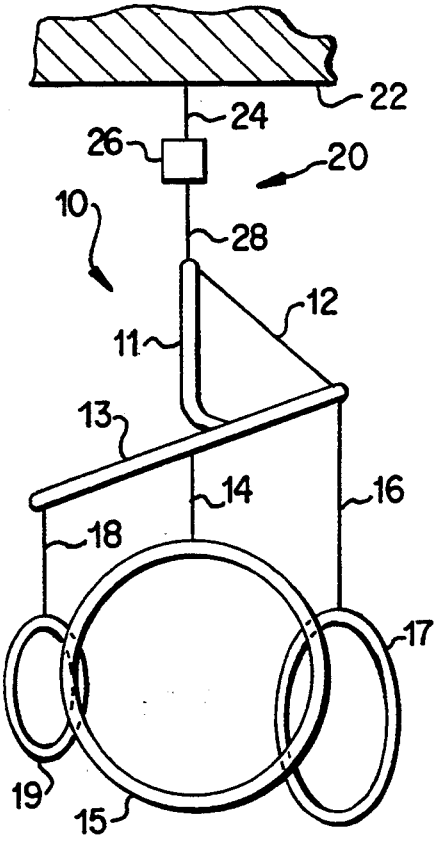
FIG. 1 is a first side view of the invention.
Figure 2:
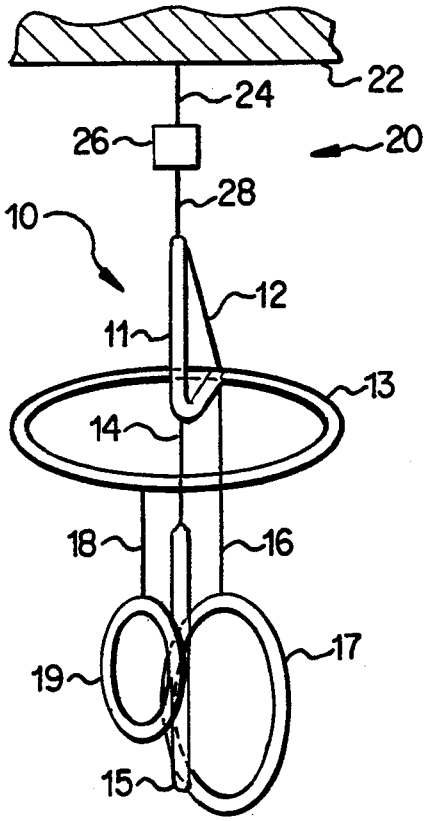
FIG. 2 is a second side view of the invention offset from the first by approximately 80°.

FIGS. 1 and 2 are different (but not orthogonal) side views of the multi-ring wind chime 10 having a support structure 20 a support bar 11 joined to an upper support ring 13 and a thin sheet wind vane 12 which collectively constitute a wind vane support assembly. Thereby, the wind vane is an integral part of and rigidly attached to the upper support ring. The support structure 20 consists of a rigid support 22, such as the branch of a tree, the cave of a house, etc., an upper support string 24, a torsional bearing 26 and a lower support string 28. The bearing 26 allows the lower sections of the wind chime to continuously rotate with only the slightest frictional resistance. However, the torsional bearing 26 could be eliminated and the strings 26 and 28 could be joined together to form a supporting means that has essentially no friction but has a torsional spring constant that, in the absence of any wind, returns the position of the vane 12 to a pre-set equilibrium position. Suspension strings 14, 16 and 18 (which are typically threads or fine wires) are fixedly attached at their upper end to the support ring 13 and attach at their lower end to the rings 15, 17 and 19 respectively.

Figure 3:
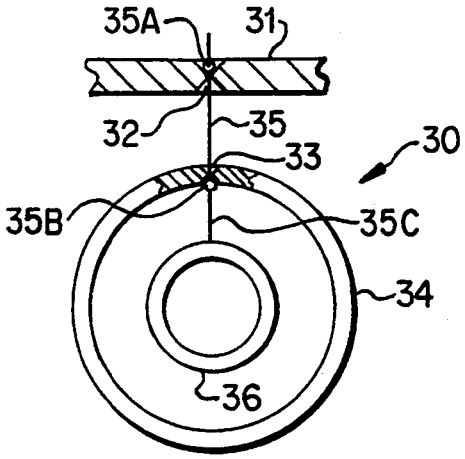
FIG. 3 is an alternative embodiment of a ring which shows details of the ring holding means.

FIG. 3 shows an alternative embodiment of a ring system 30 consisting of a support ring 31 into which a hole 32 has been drilled and countersunk from both sides. A similar hole 33 can be formed in the outer ring 34. The string 35 has an upper knot 35A, a lower knot 35B and a lower section 35 C which holds an inner ring 36. The knots 35A and 35B support the ring 34 and are hidden in the countersunk portions of the holes. The other countersunk portions of the holes 32 and 33 reduce the possibility of cutting of the string material.

The bar 11, support ring 13 and rings 15, 17, 19, 34 and 36 are preferably made from metal such as aluminum, stainless steel or brass. Anodize of various colors or other surface treatments could be used to improve the appearance of the rings if aluminum is used. The strings 24, 28, 14, 16, 18 and 35 are preferably made from thread such as monofilament nylon or drawn stainless steel wire. If wire is used, the knots 35A and 35B could be created by welding with or without the addition of a metallic bead. The vane 12 could be formed from sheet aluminum or a sheet of plastic material. It should also be understood that although only three rings are shown in FIGS. 1 and 2, any number of rings from two to several dozen could be used for this type of wind chime. Furthermore, the ring design of FIG. 3 could be used for one or more of the rings of the wind chime.

Various other modifications, adaptations, and alternative designs are, of course possible in light of the above teachings. Therefore, it should be understood at this time that within the scope of the appended claims, the invention may be practiced otherwise than as specifically described herein.

What is claimed is:

1. A multi-ring wind chime comprising:

a wind vane;

a wind vane support assembly said wind vane being an integral part of and rigidly attached to said wind vane support assembly; whereby, the wind vane support assembly is moved by a change in wind direction;

a multiplicity of rings, and;

means for suspending said rings from said wind vane support assembly sufficiently close to enable contact between said rings.

2. The multi-ring wind chime of claim 1 wherein said rings are metal.

3. The multi-ring wind chime of claim 2 wherein said metal is aluminum.

4. The multi-ring wind chime of claim 2 wherein said metal is stainless steel.

5. The multi-ring wind chime of claim 2 wherein said metal is brass.

6. The multi-ring wind chime of claim 1 wherein said suspending means suspends at least one of said rings of said wind chimes inside another one of said rings.

* * * * *